United States Patent [19]

Ziegler

[11] 4,201,345

[45] May 6, 1980

[54] FOOD CUTTER FOR DISHWASHER

[75] Inventor: William D. Ziegler, Louisville, Ky.

[73] Assignee: General Electric Company, Louisville, Ky.

[21] Appl. No.: 930,954

[22] Filed: Aug. 4, 1978

[51] Int. Cl.[2] ..... B02C 13/10; F04D 29/70

[52] U.S. Cl. ..... 241/46 R; 415/121 B

[58] Field of Search ..... 241/46 R, 46.17, 84, 241/46 A; 415/121 B, 121 G

[56] References Cited

U.S. PATENT DOCUMENTS

| | | | |
|---|---|---|---|
| 2,583,997 | 1/1952 | Chester | 415/121 B |
| 3,244,376 | 12/1965 | Schade | 415/121 B |
| 3,434,671 | 3/1969 | Cushing et al. | 241/46 R |
| 3,981,456 | 9/1976 | Hahn et al. | 241/46 R |

*Primary Examiner*—Howard N. Goldberg

*Attorney, Agent, or Firm*—Bruce A. Yungman; Radford M. Reams

[57] ABSTRACT

A food cutter is driven by a dishwasher pump located at the pump inlet to reduce the size of food particles rinsed from the dishware items washed. The food cutter includes a wire element having a wound section encircling a thread formed on a rotary driven shaft with a cutter arm portion extending radially outwardly. The wound section is frictionally restrained at its opposite end, while the direction of wind of the wound section relative to the direction of pump rotation is such as to tend to result in radial expansion of the windings causing the cutter element to be loosened in its engagement with the thread and thereby allowing a slip clutch action to prevent jamming or breakage of the cutter element. The frictional restraint of the end of the wound section is provided by a radially extending tab engaging a shoulder formed on the shaft to insure proper releasing action at a predetermined torque level.

10 Claims, 4 Drawing Figures

FOOD CUTTER FOR DISHWASHER

BACKGROUND OF THE INVENTION

This invention concerns food cutters and more particularly food cutters adapted to be used in conjunction with a dishwasher pump assembly. Such cutters are utilized in conventional dishwasher designs to eliminate food particles which remain on the dishware items and which are flushed away during the rinse cycle. Such food particles must be eliminated from the water circulation system as they have a tendency to clog the jet spray orifices in the spray arms normally provided in conventional dishwasher designs.

In early dishwasher designs there were placed fine screens at the inlet of the dishwasher circulation which captured the food particles to insure that such particles would not be introduced into the circulation system. The resultant need for frequent clean-out of the screen led to the introduction of food cutters in conjunction with a relatively coarse grading screen. The food cutters are mounted immediately upstream of the grading screen and are adapted to cooperate with the grading screen which captures large size food particles, enabling them to be contacted by a food cutter arm so as to be reduced to a size to allow them to be eliminated during the rinse cycle.

Such food cutters are designed to only handle relatively soft food particles and, accordingly, if a hard food particle or foreign object is captured by the grading screen the food cutter cannot effectively comminute the article and the grading screen thus acts to merely capture the article, with a capturing trap upstream of the inlet providing periodic clean out.

Such food cutters are driven by the same drive as the circulation pump impeller and, accordingly, it is important that the cutter mechanism is not jammed or broken upon contacting such articles, particularly when they are lodged in the grading element so as to present a fixed resistance. Heretofore, attempts have been made to allow the cutter arm to accommodate such items without jamming.

An example of one approach which has been proposed is disclosed in U.S. Pat. No. 3,981,456, assigned to the assignee of the present application.

In that patent the cutter element comprises a helically wound wire element which is anchored to an extension of the pump impeller shaft and having an extended cutting arm comprised of a terminal section of the wire form extending from the wound section. The helically wound section is largely unsupported such that the arm may allow extension and tilting of the cutter arm to thereby enable deflecting movements of the cutter arm to accommodate the encountering of such particles. While greatly improving the performance of the food cutter in this regard, it is still possible for articles to be jammed in the grading member in such a manner as to not enable tipping or axial movement of the cutter arm upon contact of the same, such that a jamming condition could still result since it has no capability for slipping of the cutter with respect to the cutter drive.

It is an object of the present invention to provide a food cutter for such applications in which the capability of the cutter to accommodate contact with such foreign or hard food objects without breakage and with a minimum tendency to create a jammed condition.

It is a further object of the present invention to provide such a food cutter which is extremely simple and low in cost to fabricate and which operates in a highly reliable and predictable manner, consistent with the design criteria applied to such components incorporated in home appliances.

SUMMARY OF THE INVENTION

These and other objects of the present invention, which will become apparent upon a reading of the following specification and claims, are provided by a cutter element consisting of a wire form having a wound section, one end portion extending radially outward to act as a cutter arm. The wound section is concentrically disposed on a cooperating threaded stud rotatably driven by the dishwasher impeller shaft. The opposite end of the wound section is urged into frictional engagement with a shoulder formed on the threaded shaft by the helical advance of the threaded engagement to restrain the other end portion against rotation on the shaft. This produces a slip clutching action by the resultant radial expansion of the wound section upon the cutter arm being loaded beyond a predetermined torque level. The direction of wind is related to the direction of pump rotation such that the radial expansion reduces the frictional engagement force to enable a slipping action between the shaft and the cutter element. The terminal end section is formed into a radially extending tab placing the side of the wire form in frictional engagement therewith to insure reliable release of the wound section at a predetermined torque overload level.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
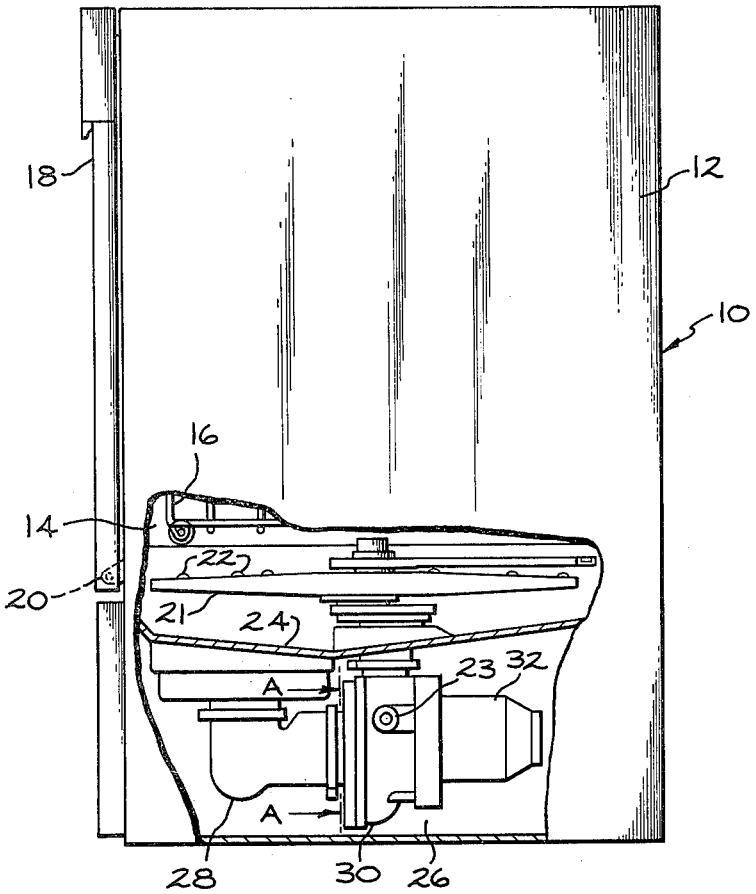
FIG. 1 is a side elevational view of a dishwasher incorporating the food cutter according to the present invention.

Referring to the drawings and particularly FIG. 1, the food cutter, according to the present invention, is contemplated as being incorporated in an automatic dishwasher 10. The dishwasher 10 includes an outer cabinet 12 within which is defined the interior cabinet space 14 receiving one or more dishwasher racks 16. Dishwasher racks 16 are configured to receive the dishware items to be washed. A front access door 18 is hinged at 20 to allow access to the interior cabinet space 14. Dishware items disposed in the racks 16 are subjected to a rinsing and washing spray by various water jet sprays directed at the dishware items such as from one or more rotary spray arms 21, having jet spray orifices 22 located to provide complete coverage of the interior cabinet space 14, to carry out the washing action in the conventional fashion.

The wash and rinse water is collected at a bottom located tub 24 within the interior cabinet space 14, for recirculation to a pump circulation and motor assembly 26 which serves to pressurize the wash and rinse water and force it through the orifices 22 to create the washing and rinsing jet sprays. The water collected in tub 24 flows through a bottom drain into a flexible boot or conduit 28 in communication with the inlet of the pump 30. A motor 32 is mounted to the pump 30 and is adapted to drive the pump impeller to create pressurization and circulation of the wash-rinse liquid either to the jet orifices 22 or to a drain outlet 23.

Figure 2:
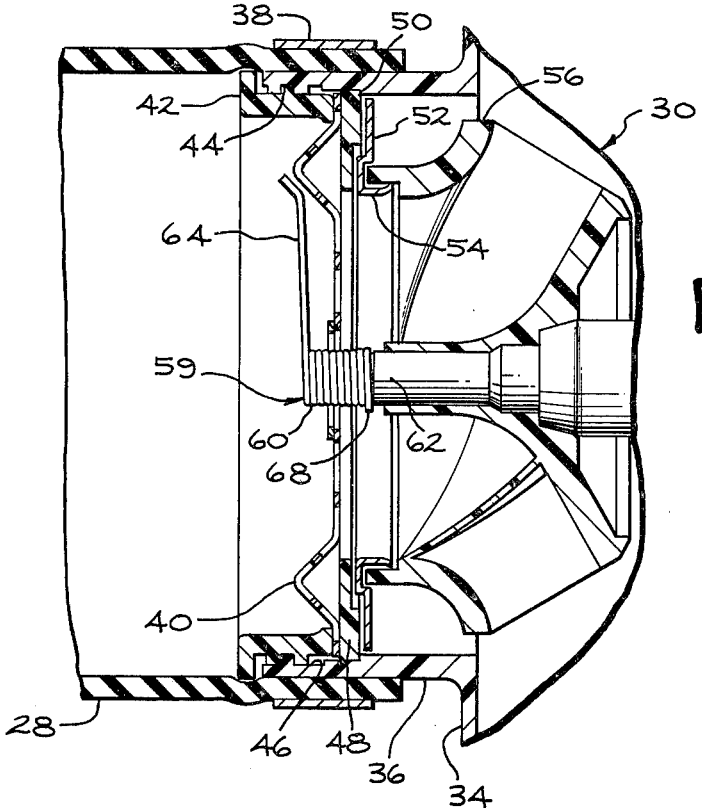
FIG. 2 is an enlarged partially sectional view of a portion of a dishwasher pump and associated components in the pump assembly incorporated in the dishwasher in FIG. 1, together with the showing of details of the food cutter.
Figure 4:
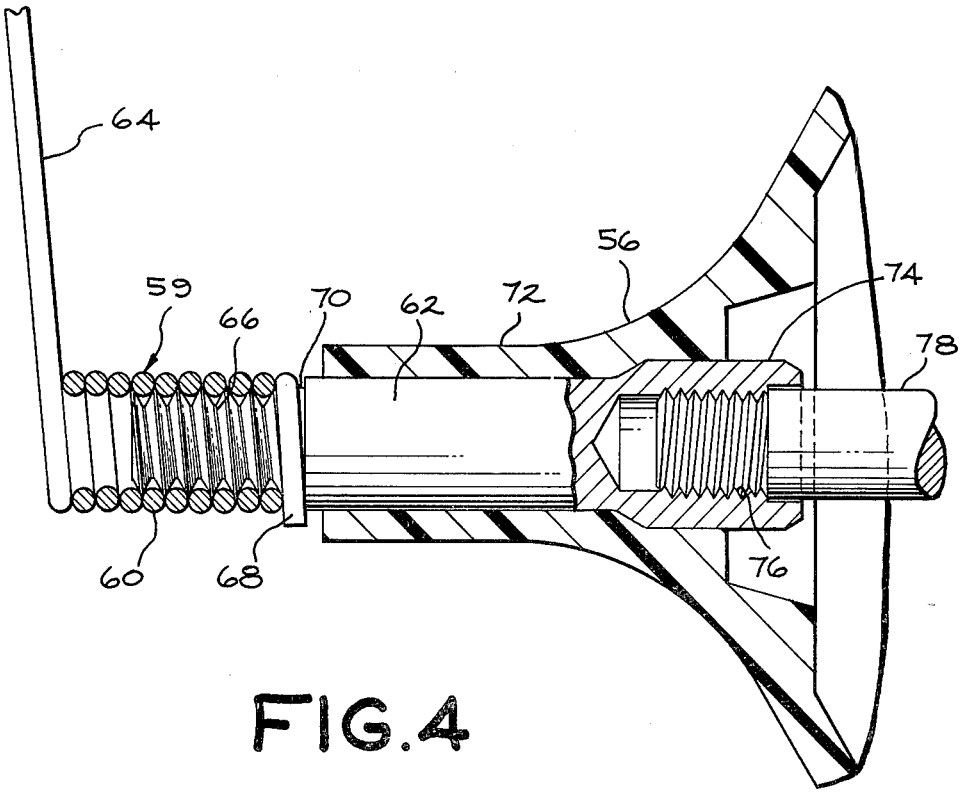
FIG. 4 is an enlarged partially sectional view depicting the installation of the food cutter element on the shaft driven by the dishwasher pump impeller.

Pump 30 includes a pump housing 34 (FIG. 2) having an extension inlet 36 which is secured to the terminal end of the flexible conduit 28 by means of a retainer strap 38.

Immediately adjacent the inlet of the pump 30 is a grading member 40 closing off the interior of the extension inlet 36. The grading member 40 is secured in position by a collar 42 threaded at 44 to cooperate with an internal thread 46 formed in the interior of the pump housing of the extension inlet 36. The collar 42 acts to compress the grading member 40 against an annular spacer 48 which in turn seats on the internal shoulder 50 formed in the interior of the inlet extension 36 of the pump housing 34.

An impeller seal 52 is also mounted intermediate the shoulder 50 which has a lip portion 54 extending about the pump impeller 56 which acts to provide a seal between the pump housing 34 and the impeller 56.

Figure 3:
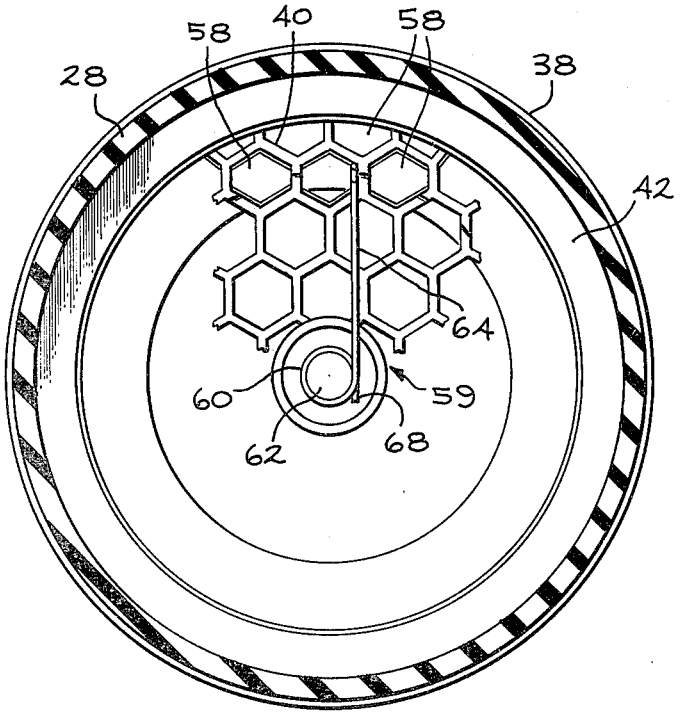
FIG. 3 is a view of the section A—A taken in FIG. 1.

As seen in FIG. 3, the grading element 40 is a relatively coarse mesh grid provided by hexagonal openings 58 to insure that relatively large food particles do not pass into the interior of the pump 30 and into the circulation system.

The grading member 40 is dished (FIG. 2) in order to confine such large food particles to the region adjacent a cutter element 59.

Cutter element 59 comprises a wound wire form having a section 60 thereof wound helically to form a spring section the turns thereof received to be concentric with the end of a rotary drive member comprised of an impeller insert shaft 62. The windings of wound section 60 are sized so that a tight frictional interengagement is provided with the end of the impeller insert shaft 62, establishing a rotary connection. A cutter arm 64 is provided by one end of the wound section radially extending therefrom.

The cutter arm 64 extends outward a sufficient distance to sweep the area defined by the dish section of the grading member 40 immediately upstream of the grading member 40 such as to comminute food particles contained in the liquid collected in the tub 24.

The cutter arm 64 is positioned immediately adjacent the grading member 40 such that large food particles are positioned against the grading member 40 so as to be comminuted by rotation of the cutter arm 64.

The cutter element 59, as noted, has a wound section 60 concentrically received by encircling the end of the impeller insert shaft 62. This encircling is preferably about an external thread 66 formed on the end of the impeller insert shaft 62 with the wound section 60 being helically wound at the same pitch and direction as external thread 66, such as to mate with the external thread 66. This provides a means for axially retaining the cutter element 59 on the impeller insert shaft 62 as well as for estabishing a frictional restraining of the other end of the wound section 60 as will be described.

The other end of the wound section 60 terminates in a tab portion 68 which extends tangentially radially outward from the windings of section 60 for a short distance and is urged by the helical advance of the threaded engagement into abutment against a shoulder 70 formed on the impeller insert shaft 62 at the termination of the external thread 66. This restrains the relative rotational movement of the end of the wound section 60 on the external thread 66 as the section is advanced thereon, by the restraining of further axial advance of the section 60 on the thread 66.

The impeller insert shaft 62 is received within a hub 72 of the pump impeller 56 and is rotatably connected thereto as by a knurling of the outside diameter of the impeller insert shaft 62 and by either a press-fitting or a molding in place of the impeller insert shaft 62, such as to securely join the impeller insert shaft 62 to the pump impeller 56 for rotation therewith.

The end of the impeller insert shaft 62 also is provided with an internal thread 76 adapted to receive a motor shaft 78 from the pump motor 32, such as to provide means to rotate both the pump impeller 56 as well as the cutter element 59 upon energization of the pump motor 32.

Thus, whenever the pump 30 is activated, the cutter arm 64 will be rotated to carry out the maceration and comminution of the soft food particles circulated to the inlet of the pump 30.

The nature of the mounting of the cutter element 59 to the impeller insert shaft 62 provides a clutching action upon the imposition of a torque on the cutter element 59 beyond a predetermined level by a controlled clutching action between the wound section 60 and the impeller insert shaft 62 and particulary the external thread form 66 formed thereon.

This clutching action is induced by the tendency of the wound section 60 when rotated in the correct direction to radially expand when the end thereof is restrained by its engagement against the shoulder 70. The radial expansion tends to reduce the frictional interengagement of the wound section 60 in engagement with the external thread 66 as the radial expansion takes place and the frictional forces thus decline as the torque impressed on the wound section 60 increases as by engagement of the cutter arm 64 with a hard food particle or foreign object, to the point where slippage will occur. Jamming of the cutter element 59 is thereby avoided, reducing the incidence of breakage.

Upon the condition creating the imposition of the abnormal torque being relieved, the relaxation of the wound section 60 instantly recreates a driving connection to enable normal rotation to continue.

Wound section 60 extends beyond the end of the impeller insert shaft 62 such that the capacity for axial extension of the cutter arm 64 and tilting thereof, as in the aforementioned U.S. Pat. No. 3,981,456, may still occur albeit to a lesser extent than the configuration described in that patent.

Tab portion 68 prevents "digging in" of the terminal portion of the wound section 60 which would create an erratic performance of the clutching action.

That is, the frictional interengagement between the shoulder 70 and tab portion 68 does not involve contact by a sharp edge or shoulder, but rather the smooth surface constituted by the side of the wire form engages the shoulder such that the frictional forces are much more predictable and the clutching action is more reliable in operation. If a sharp edge was relied on to engage a shoulder 70, frictional forces might be greatly increased or may vary greatly such as to result in erratic performance.

The clutching action is, of course, directional in that the rotation of the driving member, i.e. the impeller insert shaft 62, must be in the same direction to the winding of the wound section 60 when it is received over the driving member such that the imposition of the torque by rotation of the cutter arm 64 into engagement with a fixed resistance tends to radially expand and release the wound section 60.

Thus, the external thread 66 and wound section 60 must be so oriented with respect to the predetermined direction of rotation of the pump impeller 56.

If the wound section 60 were instead received within an opening in the driving member, the frictional engagement would be relieved by a rotation in the opposite direction as the windings.

Accordingly,, the food cutter is afforded a controlled reliable overload release due to clutching action allowing slip between the cutter arm and the pump impeller drive. The components required to provide this result are extremely simple and reliable in operation suiting the same to application in dishwashers due to the minimizing of maintenance requirements and the inclusion of this feature at a relatively low cost.

The embodiments of the invention in which an exclusive property or privilege is claimed are defined as follows:

1. A rotary cutter comprising:

a rotary member;

means for rotating said member in a predetermined direction;

a cutter element driven by said rotary member, said cutter element comprising a wire form including a wound section, and further comprising an elongated cutter arm driven by one end of said wound section extending radially outward from said wound section;

said wound section received in concentric normally frictionally engaging relationship with a portion of said rotary member, with the direction of wind of said wound section being such that rotation of said cutter arm in said predetermined direction tends to cause said wound section to be radially expanded to reduce said frictional engagement upon contact of said cutter arm with articles introduced into said food cutter;

means for restraining relative rotation between the other end of said wound section and said rotary member;

whereby said means restraining said end portion of said wound section on said rotary member expands said wound section and releases said frictional interengagement upon restraint of said cutter arm to develop a predetermined torque level and whereby a clutch slipping action between said rotary member and said wire form is achieved.

2. The rotary cutter according to claim 1 wherein said means for restraining said other end of said wound section comprises a shoulder formed on said rotary member frictionally engaged by said end portion of said wound section of said cutter element.

3. The rotary cutter according to claim 2 wherein said means for restraining said other end of said wound section further includes a helical configuration of said wound section and a helical thread formed on said rotary member in mating relationship with said helical windings of said wound section of said cutter element, said direction of said thread tending to advance said end of said wound section into tighter frictional engagement with said shoulder upon rotation of said cutter element upon imposition of said torque level on said cutter element tending to rotate said cutter element relative to said rotary member in a direction opposite to said predetermined direction of rotation of said member, whereby the tendency for axial advance produces an increasing restraining force on said end portion with increasing torque levels.

4. The rotary cutter according to claim 3 wherein said end portion extends radially outward from said windings of said wound section, whereby said frictional engagement is established between the side of said wire form and said shoulder.

5. The rotary cutter according to claim 4 wherein said thread form is an external thread form and wherein said wound section of said cutter element is received over said external thread.

6. A pump and motor assembly for use with a dishwasher comprising a pump housing having an inlet and an outlet, a rotatable shaft having an impeller for rotation within said housing in a predetermined direction to provide for pumping of fluid from said inlet toward said outlet;

a food particle grading member disposed across said inlet and having a plurality of openings through which fluid entering said inlet must pass to reach said impeller;

a food cutter element driven by said shaft, said cutter element comprising a wire form including a wound section, and further comprising an elongated cutter arm driven by one end of said wound section extending radially outward from said wound section;

said wound section received in concentric normally frictionally engaging relationship with a portion of said rotary member with the direction of wind of said wound section being such that rotation of said cutter in said predetermined direction tends to cause said wound section to be radially expanded to reduce said frictional engagement upon contact of said cutter are with items introduced into said food cutter;

means for frictionally restraining relative rotation between the other end of said wound section and said rotary member;

whereby said means restraining said end portion of said wound section on said rotary member expands said wound section and releases said frictional interengagement upon restraint of said cutter arm to develop a predetermined torque level and whereby a clutch slip action between said rotary member and said wire form is achieved.

7. The pump and motor assembly according to claim 6 wherein said means for restraining said other end of said wound section comprises a shoulder formed on said shaft frictionally engaged by said end portion of said wound section of said cutter element.

8. The pump and motor assembly according to claim 7 wherein said means for restraining said other end of said wound section further includes a helical configuration of said wound section and a helical thread formed on said shaft in mating relationship with said helical windings of said wound section of said cutter element, said direction of said thread tending to advance said end of said wound section into tighter frictional engagement with said shoulder upon rotation of said cutter element upon imposition of said torque level on said cutter element tending to rotate said cutter element relative to said shaft in a direction opposite to said predetermined direction of rotation of said shaft, whereby the tendency for axial advance produces an increasing restraining force on said end portion with increasing torque levels.

9. The pump and motor assembly according to claim 8 wherein said end portion extends radially outward from said windings of said wound section, whereby said frictional engagement is established between the side of said wire form and said shoulder.

10. The pump and motor assembly according to claim 9 wherein said thread form is an external thread form and wherein said wound section of said cutter element is received over said external thread.

* * * * *